US006148600A

United States Patent [19]

Farmer et al.

[11] Patent Number: 6,148,600

[45] Date of Patent: Nov. 21, 2000

[54] ONE-PIECE SHEET METAL COWL FOR COMBUSTOR OF A GAS TURBINE ENGINE AND METHOD OF CONFIGURING SAME

[75] Inventors: Gilbert Farmer, Cincinnati; Mehmet M. Dede, West Chester, both of Ohio; James A. Goreschen, Hebron, Ky.; William T. Houchens, Cincinnati, Ohio

[73] Assignee: General Electric Company, Cincinnati, Ohio

[21] Appl. No.: 09/259,038

[22] Filed: Feb. 26, 1999

[51] Int. Cl.[7] ..... F02C 3/06

[52] U.S. Cl. ..... 60/39.02; 60/39.36

[58] Field of Search ..... 60/39.36, 39.02, 60/748, 752, 756

[56] References Cited

U.S. PATENT DOCUMENTS

| | | | |
|---|---|---|---|
| 4,979,361 | 12/1990 | Clark et al. | 60/39.36 |
| 5,289,687 | 3/1994 | Kress et al. | 60/747 |
| 5,924,288 | 7/1999 | Fortuna et al. | 60/752 |
| 5,956,955 | 9/1999 | Schmid | 60/748 |
| 5,974,805 | 11/1999 | Allen | 60/640 |

*Primary Examiner*—Timothy S. Thorpe
*Assistant Examiner*—Ehud Gartenberg
*Attorney, Agent, or Firm*—Andrew C. Hess; Rodney M. Young

[57] ABSTRACT

A one-piece cowl for use in assembled relationship with a combustor of a gas turbine engine, the cowl being of a generally annular configuration defining a central cowl axis and being axially elongated and aerodynamically contoured relative to the central cowl axis. The one-piece cowl includes an inner annular portion, an outer annular portion, and a plurality of circumferentially spaced radial ligaments connecting the inner and outer annular portions so as to form a corresponding number of openings through a middle portion of the cowl. Each radial ligament has a designated area which enables the radial ligaments to sustain the stress levels imposed on the cowl to prevent high cycle fatigue. Each opening also has a designated area which enables insertion of fuel nozzles therein without adversely affecting air flow therethrough. The designated area for the radial ligaments is a function of the designated area for the openings and a ratio of such areas falls within a specified range.

18 Claims, 4 Drawing Sheets

ONE-PIECE SHEET METAL COWL FOR COMBUSTOR OF A GAS TURBINE ENGINE AND METHOD OF CONFIGURING SAME

FIELD OF THE INVENTION

The present invention relates to the cowl associated with a combustor in a gas turbine engine and, more particularly, to a one-piece sheet metal cowl which is able to sustain the stress levels thereon to prevent high cycle fatigue while enabling proper air flow to the combustor.

BACKGROUND OF THE INVENTION

In a gas turbine engine, pressurized air is provided from the compressor stage to the combustor, whereupon it is mixed with fuel and is burned in the combustion chamber. The amount of pressurized air which enters the fuel/air mixers. and correspondingly the inner and outer passages of the combustor, has typically been regulated by inner and outer cowls located upstream of the fuel/air mixers and the combustor dome. Such cowls have been generally held in place by means of a bolted joint which includes the combustor dome, the cowl, and either the inner or outer combustor liner. Accordingly, both the outer and inner cowls of a gas turbine engine experience a slight change in pressure thereacross, as well as a vibratory load induced by the engine. While these environmental factors have a greater effect on the outer cowl, they nevertheless cause wear on both cowls and consequently limit the life thereof.

In addressing this problem, the prior art has generally taken one of two approaches. The first of which involves use of a sheet metal body for the cowls with a lip formed at the leading edge thereof, preferably by curling or wrapping the sheet metal around a damper wire. However, it has been found that this design is life-limited due to a rubbing-type wear occurring at the interface of the wire and the sheet metal body caused by a thermal mismatch between the wire and the wrap. More specifically, the thermal mismatch causes the sheet metal to unwrap around the wire. creating a gap between the wire and the cowl. In addition, white noise exiting the diffuser and/or combustor acoustics create high cycle fatigue vibratory loading of the wire against the sheet metal wrap. Thus, the combined rubbing and vibratory induced shaking of the wire against the metal wrap result in the wrapped portion of the cowl thinning, cracking and eventually liberating sheet metal and wire fragments. Failures of cowls having this design have been found to occur at substantially less than the cowl HCF life requirement for the applicable engine.

Another cowl design involves a machined ring which forms the leading edge lip of the cowl, where the ring is welded to a formed sheet metal body. Such a machined ring provides a solid lip for the cowl, which is desirable, but circumferential welding thereof to the formed sheet metal body has resulted in stress concentrations both in and around the weld which are sources of failure initiation of the cowl. Yet another one-piece cowl design is disclosed in a U.S. patent application entitled "One-Piece Combustor Cowl" and having Ser. No. 08/811,754 now, U.S. Pat. No. 5,924, 288, to Fortuna, which discloses a cowl which is casted that has a solid lip of increased thickness at a leading edge thereof. while suitable for its intended purpose, this cowl tends to be both heavier and more costly than a sheet metal cowl.

Accordingly, it is desirable for a one-piece gas turbine engine cowl to be developed for use with combustors which is able to sustain the stress levels imposed thereon for a desirable number of hours without succumbing to high cycle fatigue and still direct air flow to the combustor in a manner consistent with the requirements of the fuel/air mixers and the inner/outer passages. It is also desirable for such a cowl to be both lightweight and inexpensive in terms of materials, processing and specific fuel consumption.

SUMMARY OF THE INVENTION

In an exemplary embodiment of the invention, a one-piece cowl for use in assembled relationship with a combustor of a gas turbine engine is disclosed, the cowl being of a generally annular configuration defining a central cowl axis and being axially elongated and aerodynamically contoured relative to the central cowl axis. The one-piece cowl includes an inner annular portion, an outer annular portion, and a plurality of circumferentially spaced radial ligaments connecting the inner and outer annular portions so as to form a corresponding number of openings through a middle portion of the cowl. Each radial ligament has a designated area which enables the radial ligaments to sustain the stress levels imposed on the cowl to prevent high cycle fatigue. Each opening also has a designated area which enables insertion of at least one fuel nozzle therein without adversely affecting air flow therethrough.

In a second exemplary embodiment of the invention, a method of configuring a one-piece, sheet metal annular cowl for a gas turbine engine combustor is disclosed as including the following steps: providing a plurality of circumferentially spaced radial ligaments to connect an inner annular portion and an outer annular portion so that a plurality of openings are formed through a middle portion of the cowl; sizing each opening so as to have an area which enables insertion of a fuel nozzle therein without adversely affecting air flow therethrough; and, sizing each radial ligament so as to have an area which enables a specified stress level to be imposed on the cowl without experiencing high cycle fatigue. The sizing steps for the radial ligaments and the openings are both satisfied when a specified ratio of the respective areas therefor is achieved.

DESCRIPTION OF THE DRAWING

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
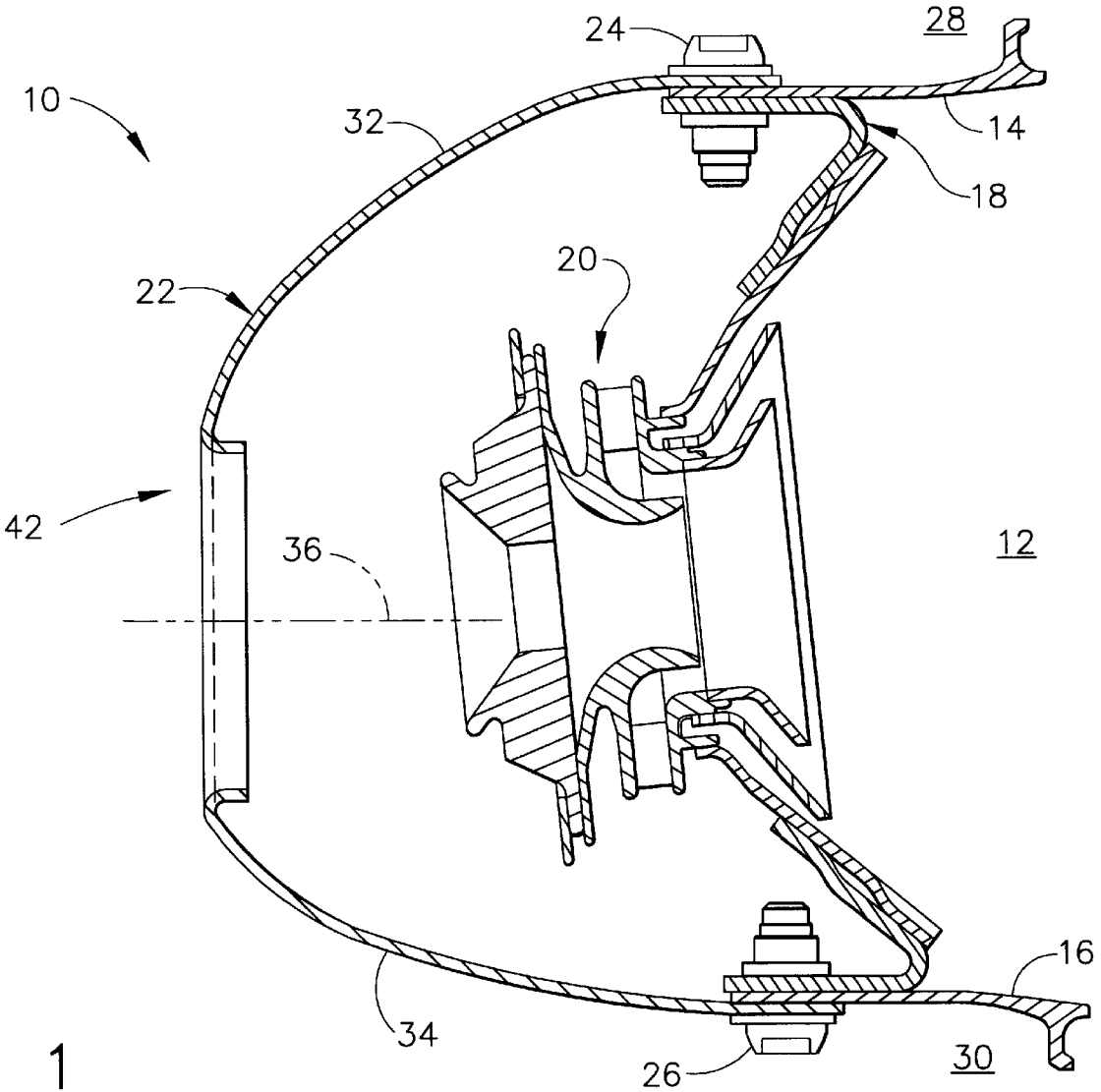
FIG. 1 is a longitudinal cross-sectional view of a gas turbine engine combustor including a cowl in accordance with the present invention.

Referring now to the drawing in detail, wherein identical numerals indicate the same elements throughout the figures, FIG. 1 depicts a single annular combustor 10 of the type suitable for use in a gas turbine engine and defining a combustion chamber 12 therein. Combustor 10 is generally annular in form and includes an outer liner 14, an inner liner 16, and a domed end or dome 18. In the present annular configuration, the domed end 18 of combustor 10 further includes a plurality of air/fuel mixers 20 of known design spaced circumferentially therearound.

In the combustor depicted in FIG. 1, a one-piece cowl 22 is provided upstream of combustor 10 and attached to outer and inner liners 14 and 16, as well as dome 18, at outer and inner bolted connections 24 and 26, respectively. Cowl 22 performs the function of properly directing and regulating the flow of pressurized air from a diffuser of the gas turbine engine to dome 18 and outer and inner passages 28 and 30 located adjacent outer and inner liners 14 and 16, respectively. It will be understood from FIGS. 1 and 2 that cowl 22 is annular in shape like combustor 10 and includes an outer annular portion 32 and an inner annular portion 34 with a central cowl axis 36 running therethrough. As is typical with combustor cowls, outer and inner annular cowl portions 32 and 34 are axially elongated and aerodynamically contoured relative to central cowl axis 36.

In order to configure cowl 22 as a one-piece design, a plurality of radial members or ligaments 38 are circumferentially spaced about cowl 22 to connect outer and inner annular portions 32 and 34. Accordingly, a corresponding number of openings or windows 40 are formed through a middle annular portion 42 of cowl 22. It will be appreciated that each radial ligament 38 has a designated area $A_{RL}$ which enables cowl 22 to sustain the stress levels imposed thereon for an acceptable number of operating hours (e.g., 25,000 hours) before high cycle fatigue (HCF) becomes a concern. Likewise, each opening 40 has a designated area $A_W$ which enables insertion of one or more fuel nozzles therein without adversely affecting air flow therethrough. In the design depicted, fifteen openings 40 have been formed in which thirty fuel nozzles, or two for each opening, are allocated. It will be understood, however, that the total number of openings can be tailored to the number of fuel nozzles by adjusting the size of such openings (i.e., thirty openings for thirty fuel nozzles).

Since desired air flow into combustor 10 is typically difficult to achieve, and is clearly affected by any change in design for cowl 22, it will be understood that radial ligaments 38 and openings 40 are properly sized and configured with respect to each other for the aforementioned goals relating to handling of stress levels and air flow to be achieved. In this regard, it has been found that area $A_{RL}$ of each radial ligament 38 and area $A_W$ for each opening 40 are interrelated so that a preferred ratio therebetween ($A_W/A_{RL}$) is within a range of 2–7 and optimally within a range of 3–6.

Figure 2:
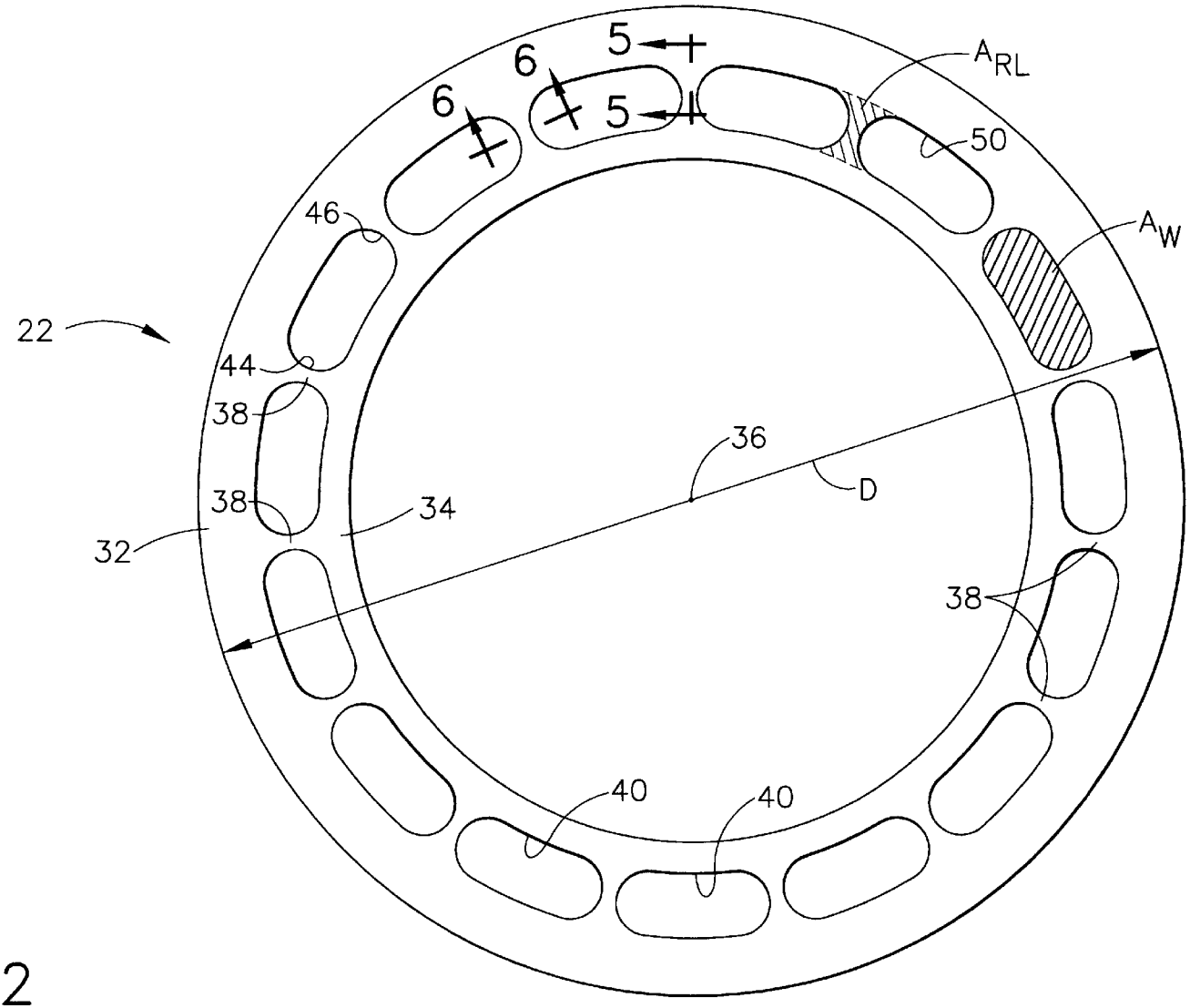
FIG. 2 is a forward looking aft view of the cowl depicted in FIG. 1.
Figure 3:
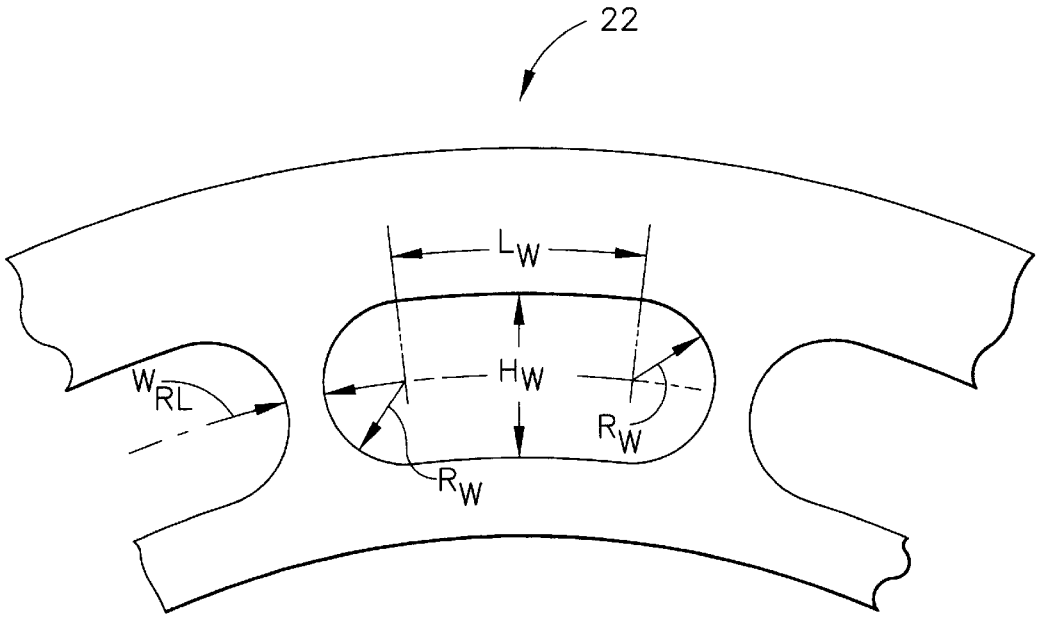
FIG. 3 is an enlarged. partial view of the cowl depicted in FIG. 2.
Figure 4:
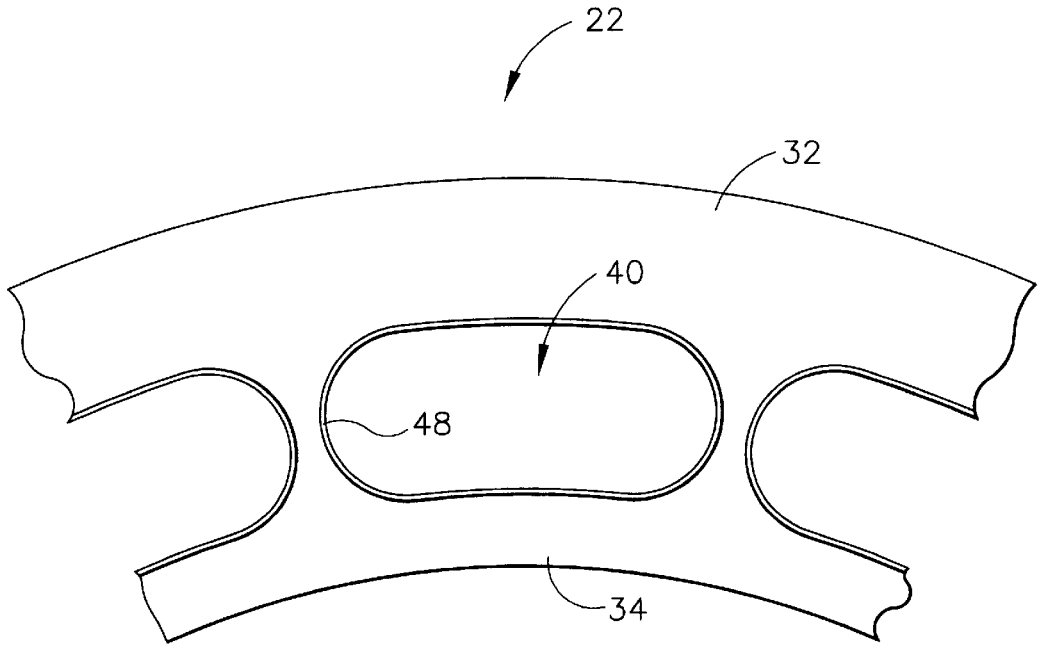
FIG. 4 is a partial aft looking forward view of the cowl depicted in FIGS. 1–3.

It will further be seen from FIGS. 2–4 that openings 40 have a designated radial height $H_W$ and are rounded at each circumferential end 44 and 46 to have a radius $R_W$. The area $A_W$ of each opening 40 is then calculated approximately as the radial height $H_W$ of opening 40 times a length $L_W$ of such opening between centerpoints for the radius $R_W$ at each circumferential end 44 and 46. This product is then added to $\pi R_W^2$ (where each circumferential end is a semi-circle having radius $R_W$). Since the radial height $H_W$ of opening 40 is typically set in light of a specified outer cowl diameter D, radius $R_W$ is a function of radial height $H_W$ so that a ratio of radial height to the radius for opening 40 ($H_W/R_W$) is preferably within a range of 2–2.5 and optimally within a range of 2.3–2.4.

Since each radial ligament 38 is defined by the spacing and configuration of two adjacent openings 40, it will be appreciated that the area $A_{RL}$ thereof is a function of the radial height $H_W$ of opening 40 times the width $W_{RL}$ of radial ligament 38. Of course. width $W_{RL}$ is not constant across radial height $H_W$ of opening 40 due to the semi-circular shape of openings 40 at each circumferential end 44 and 46 thereof.

Figure 5:
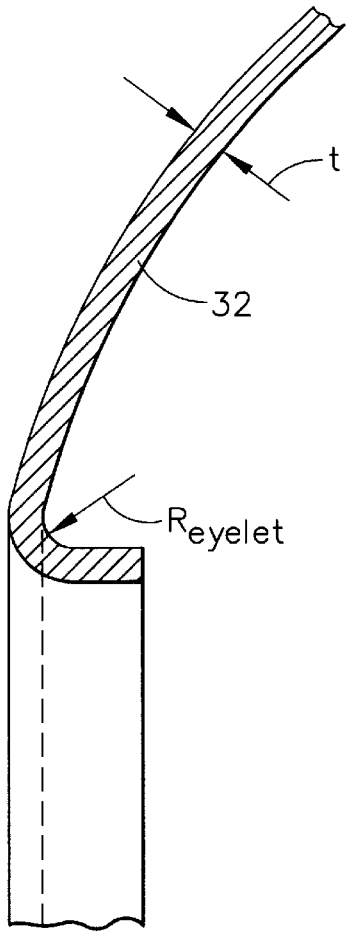
FIG. 5 is an enlarged, partial cross-sectional view of the cowl depicted in FIGS. 1–4 and taken along line 5—5 in FIG. 2.
Figure 6:
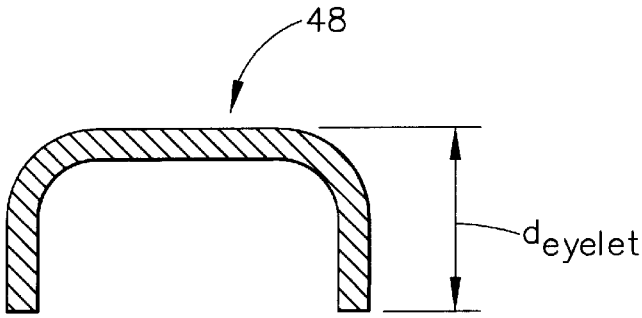
FIG. 6 is an enlarged, partial cross-sectional view of the cowl depicted in FIGS. 1–5 and taken along line 6—6 in FIG. 2.

Additionally, FIGS. 4–6 depict each opening 40 as preferably having an eyelet or lip 48 extending axially aft a specified distance $d_{eyelet}$ from an edge 50 defining the perimeter of opening 40. Eyelet 48 is also curved with respect to opening edge 50 so that it has a radius $R_{eyelet}$ which is a function of axial distance $d_{eyelet}$ so that a ratio of the axial distance to the radius for eyelet 48 ($d_{eyelet}/R_{eyelet}$) is preferably within a range of 2.0–4.0 and optimally within a range of 2.5–3.9. It will be appreciated that eyelet 48 will normally be formed as part of a stamping process since at least middle annular portion 42 of cowl 22 is preferably made of sheet metal. Accordingly, the axial distance $d_{eyelet}$ for each eyelet 48 is a function of the thickness t of the sheet metal forming middle annular portion 42 so that a ratio of the axial distance to the sheet metal thickness ($d_{eyelet}/t$) is preferably within a range of 4–8 and optimally within a range of 5–7.

As stated hereinabove, it is desired that cowl 22 be both lightweight and inexpensive. In order to achieve this, outer and inner annular portions 32 and 34 of cowl 22, as well as middle annular portion 42, preferably are made of sheet metal. It will be appreciated that the thickness t of such sheet metal, which is influenced by the diameter D of cowl 22, has an influence on the axial distance $d_{eyelet}$ of eyelet 48 as noted above. Accordingly. a preferred ratio of the cowl outer diameter to the sheet metal thickness (D/t) is 700–850 and an optimal range is 746–826.

It will be seen that the process of configuring cowl 22 first includes providing a plurality of circumferentially spaced radial ligaments 38 to connect outer annular portion 32 and inner annular portion 34 so that a plurality of openings 40 are formed through a middle annular portion 42 of cowl 22. Then, radial ligaments 38 are sized to have an area $A_{RL}$ which enables a specified stress level to be imposed on cowl 22 without experiencing high cycle fatigue for an acceptable number of hours and openings 40 are sized to have an area $A_W$ which enables insertion of at least one fuel nozzle therein without adversely affecting air flow therethrough. It will be appreciated that the sizing of radial ligaments 38 and openings 40 is directly related to each other and will be satisfied when a ratio therebetween (i.e., $A_W/A_{RL}$) falls within a designated range.

Additional steps include sizing a thickness t for the sheet metal of cowl 22 as a function of an outer cowl diameter D so as to fall within a designated range, sizing a radius $R_W$ at each circumferential end 44 and 46 of openings 40 as a function of a radial height $H_W$ for such openings 40, and providing an eyelet 48 extending axially aft from each opening 40 a designated distance $d_{eyelet}$. With respect to each eyelet 48 axial distance $d_{eyelet}$ is a function of thickness t for the cowl sheet metal and each one is curved to have a radius $R_{eyelet}$ which is a function of axial distance $d_{eyelet}$.

Having shown and described the preferred embodiment of the present invention, further adaptations of the gas turbine engine cowl, and particularly the number and relative size of the radial ligaments and openings thereof for a specific engine or combustor application, can be accomplished by appropriate modifications by one of ordinary skill in the art without departing from the scope of the invention.

What is claimed is:

1. A one-piece cowl for use in assembled relationship with a combustor of a gas turbine engine, said cowl being of a generally annular configuration defining a central cowl axis and being axially elongated and aerodynamically contoured relative to said central cowl axis, comprising:

(a) an inner annular portion;

(b) an outer annular portion; and (c) a plurality of circumferentially spaced radial ligaments connecting said inner and outer annular portions so as to form a corresponding number of openings through a middle portion of said cowl, each said radial ligament having a designated area which enables said radial ligaments to sustain the stress levels imposed on said cowl to prevent high cycle fatigue and each said opening having a designated area which enables insertion of at least one fuel nozzle therein without adversely affecting air flow therethrough.

2. The one-piece cowl of claim 1, wherein said designated area for each said radial ligament is a function of said designated area for each said opening.

3. The one-piece cowl of claim 1, said openings being rounded at each circumferential end so as to have a radius.

4. The one-piece cowl of claim 1, each of said openings having a designated radial height, wherein said radius at each circumferential end is a function of said designated radial height thereof.

5. The one-piece cowl of claim 1, each said opening having an eyelet extending axially aft a specified distance from the edge defining such opening.

6. The one-piece cowl of claim 5, wherein said axial distance of said opening lip is a function of a thickness of the material forming said cowl.

7. The one-piece cowl of claim 5, said eyelet for each opening being curved with respect to the edge defining such opening so as to have a designated radius.

8. The one-piece cowl of claim 7, said designated radius of said eyelet being a function of said axial distance for said eyelet.

9. The one-piece cowl of claim 1, wherein said inner annular portion, said outer annular portion, and said radial ligaments are made of sheet metal.

10. The one-piece cowl of claim 9, wherein the sheet metal of said cowl has a designated thickness which is a function of a diameter for said cowl.

11. The one-piece cowl of claim 3, wherein a width for each said radial ligament changes along the radial height therefor.

12. A method of configuring a one-piece, sheet metal annular cowl for a gas turbine engine combustor, comprising the following steps:

(a) providing a plurality of circumferentially spaced radial ligaments to connect an inner annular portion and an outer annular portion so that a plurality of openings are formed through a middle annular portion of said cowl;

(b) sizing each said opening so as to have an area which enables insertion of a fuel nozzle therein without adversely affecting air flow therethrough; and (c) sizing each said radial ligament so as to have an area which enables a specified stress level to be imposed on said cowl without experiencing high cycle fatigue;

wherein the sizing steps for said radial ligaments and said openings are both satisfied when a designated ratio of said respective areas therefor is achieved.

13. The method of claim 12, further comprising the step of sizing a thickness for the sheet metal as a function of an outer cowl diameter so as to fall within a designated range.

14. The method of claim 12, further comprising the step of sizing a radius at each circumferential end of said opening as a function of a radial height for each said opening.

15. The method of claim 12, further comprising the step of providing a eyelet extending axially aft from each said opening a designated distance.

16. The method of claim 15, wherein said axial distance of said eyelets are a function of a thickness for the sheet metal of said cowl.

17. The method of claim 15, wherein said eyelets for said openings are curved to have a radius.

18. The method of claim 17, said eyelet radius being a function of said axial distance thereof.

* * * * *